United States Patent [19]

Siniscal et al.

[11] Patent Number: 4,478,327

[45] Date of Patent: Oct. 23, 1984

[54] NEWSPAPER CONTAINER UNLOADING APPARATUS

[75] Inventors: Paul D. Siniscal, Hollis; J. Paige Benzing, Milford, both of N.H.; Louis G. Matte, Lowell, Mass.

[73] Assignee: Rockwell International Corporation, Pittsburgh, Pa.

[21] Appl. No.: 382,541

[22] Filed: May 27, 1982

[51] Int. Cl.[3] ..... B65G 11/20

[52] U.S. Cl. ..... 193/40; 414/43; 414/414; 414/680

[58] Field of Search ..... 414/411, 414, 31, 45, 414/108, 109, 330, 43; 221/11; 198/347, 525, 488, 409; 193/25 AC, 25 FT, 32, 40

[56] References Cited

U.S. PATENT DOCUMENTS

| | | | |
|---|---|---|---|
| 1,850,955 | 3/1932 | Fear | 226/67 X |
| 2,656,961 | 10/1953 | Bevington | 271/148 X |
| 2,687,070 | 8/1954 | Gastright | 271/148 X |
| 2,797,098 | 6/1957 | Brodie | 414/109 X |
| 2,851,269 | 9/1958 | Zook | 271/148 |
| 3,374,902 | 3/1968 | Mills | 414/45 X |
| 3,565,237 | 2/1971 | Strydom | 198/525 |
| 3,881,716 | 5/1975 | Bryson et al. | 270/54 X |
| 3,889,095 | 8/1975 | Wiese | 414/414 X |
| 4,365,703 | 12/1982 | Hinchcliffe et al. | 198/347 |

*Primary Examiner*—Joseph E. Valenza
*Assistant Examiner*—Stuart Millman

[57] ABSTRACT

An apparatus for removing newspapers from a container in a newspaper live storage buffer having an indexing unit for moving the containers individually from the buffer's conveying device to an unloading position. In the unloading position a pneumatically controlled paddle is raised to engage the newspapers within the container and at approximately the same time a gate forming the bottom of the container is unlatched to permit it to swing to an open position. The paddle is then lowered and is effective in guiding the newspapers into an arcuated channel from which they are delivered for further processing downstream of the buffer.

3 Claims, 5 Drawing Figures

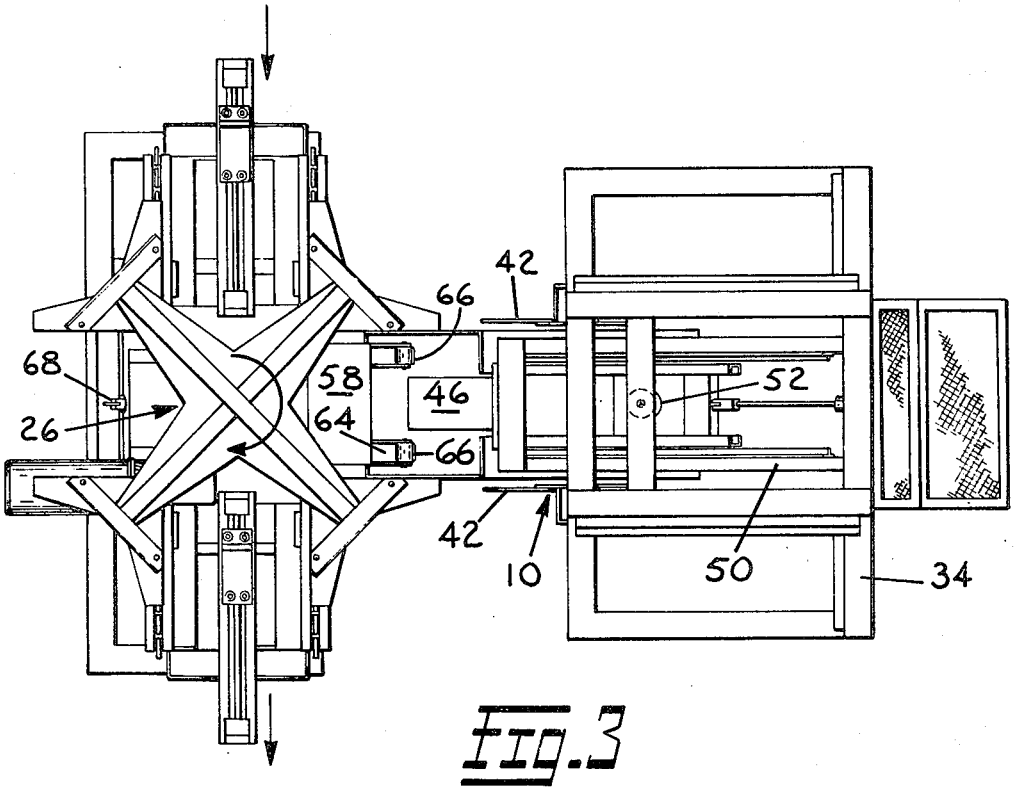
FIG. 3
FIG. 4
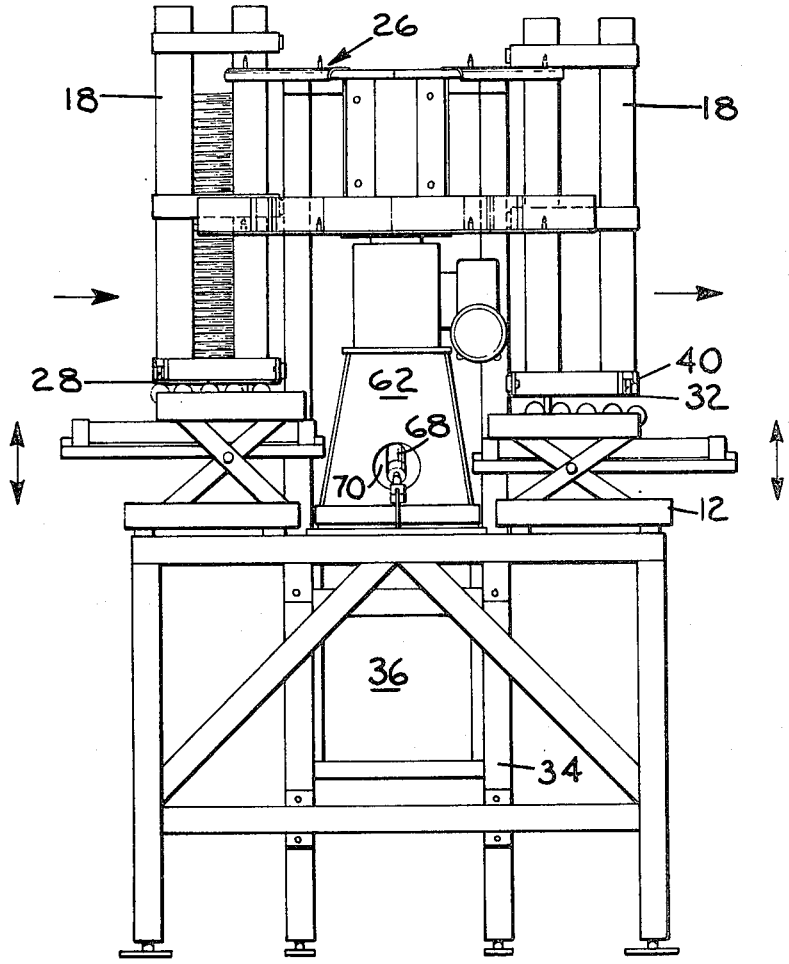

NEWSPAPER CONTAINER UNLOADING APPARATUS

BACKGROUND OF THE INVENTION

The newspaper container unloading apparatus according to the invention forms a part of a newspaper live storage buffer which is an automatic system for handling newspapers as they leave the printing press whereby a reserve supply can be maintained that is capable of compensating for unintentional shut-down of the press as well as other devices downstream of the storage buffer which effect further processing of said newspapers.

U.S. Pat. No. 3,881,716 discloses an apparatus for handling newspapers which includes an accumulator for receiving newspapers from the press and storing them in static form in the event the stuffers or other downstream devices should stop and interrupt the flow of newspapers that normally bypass the accumulator.

The container unloading apparatus comprising the invention is considered a definite advance in the art, for the newspapers as they leave the press, are directed to a container loading unit and thence the loaded container is conveyed to said unloading apparatus whereat the newspapers are removed from the containers for further processing in the same order in which they were printed.

SUMMARY OF THE INVENTION

The newspaper container unloading apparatus according to the invention includes a support structure operatively connected to the buffer system's conveying unit as well as an indexing unit for sequentially removing the loaded containers from said conveying unit and when emptied to return them thereto. The support structure includes an arcuated channel member with the top thereof defining a container unloading position. The indexing unit holds a container in the unloading position while the newspapers are being removed therefrom and is then effective in returning the emptied container to the conveying unit. The bottom of the containers are provided with pivotable gate elements that are held in a closed position by latching levers and are unlatched when desired by pneumatically controlled latch trips mounted on the support structure. Additionally the support structure has a pneumatically controlled paddle member mounted therein which is capable of entering and being withdrawn from the arcuated channel member and while in the latter, it is pivoted upwardly into contact with the newspapers within a container. After the paddle member engages the newspapers within the container, the gate element is unlatched and caused to swing downwardly so that the weight of the newspapers then rests on said paddle member. The paddle member is then caused to pivot downwardly and is effective in guiding the newspapers into the arcuated channel from which they are subsequently advanced for further processing downstream of the live storage buffer.

It is a general object of the invention to provide a container unloading apparatus for a newspaper live storage buffer system which is automatic and will not require intervention on the part of an operator.

Other objects and advantages of the invention will become more fully apparent by reference to the appended claims and as the following detailed description proceeds in reference to the figures of drawing wherein:

BRIEF DESCRIPTION OF THE DRAWINGS

FIG. 3 is a top view of the apparatus shown in FIG. 2;

FIG. 4 is an end view of the apparatus as seen loading from the left side of FIG. 2.

DESCRIPTION OF THE PREFERRED EMBODIMENT

Figure 1:
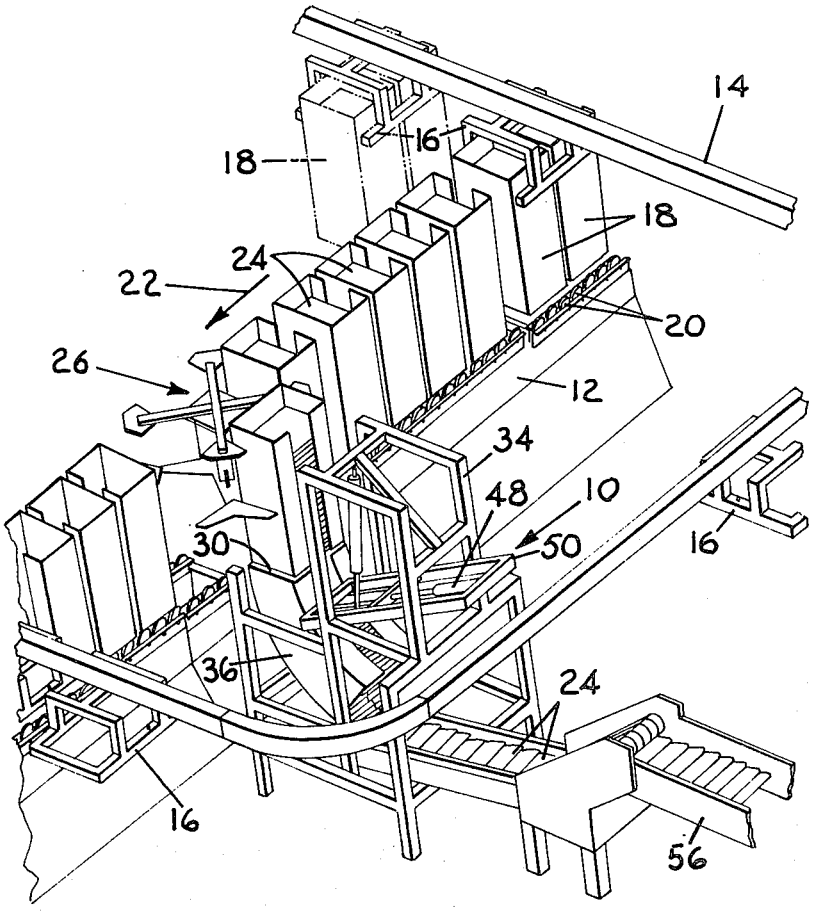
FIG. 1 is a perspective view of a portion of a newspaper live storage buffer showing the newspaper container unloading apparatus according to the invention operatively associated therewith.

Referring now to FIG. 1 the newspaper container unloading apparatus comprising the invention is identified generally by numeral 10 and is operatively associated with a transfer conveyor 12. This transfer conveyor 12 is in turn operatively associated with an endless conveyor 14 which is provided with a plurality of carrier elements 16 that depend from a driven chain (not shown) for effecting travel of said carrier elements about the entire pathway of said endless conveyor.

As shown in FIG. 1 each carrier element 16 is capable of supporting a pair of container members 18 and are adapted to release said container members onto roller members 20 which form the upper portion of the transfer conveyor 12. By any appropriate means not shown such as pneumatic cylinders, the containers are caused to travel in the direction of the indicating arrow 22 in FIG. 1. The containers traveling in this direction are loaded with superposed newspapers 24 and are individually received by an indexing rotor that is identified generally in the various figures of drawings by numeral 26. The indexing rotor 26 is effective after receiving a container in the position depicted by numeral 28 (FIG. 4) in moving the container to its unloading position which is identified by numeral 30. The unloading of the newspapers will be described in greater detail hereinafter and the containers after being emptied are moved by the indexing rotor to the position depicted by numeral 32 (FIG. 4). This position 32 returns the emptied container to the transfer conveyor 12 and the containers are subsequently returned to the carrier elements 16 where they will be caused to repeat the cycle of being loaded and unloaded.

The unloading apparatus according to the invention includes a support structure 34 located in operative association with the transfer conveyor 12 and the indexing rotor 26. This support structure 34 has a chute or arcuated channel 36 fixed therein and its upper end is disposed in close proximity with the bottom of a container 18 when the latter is in its unloading position 30. The bottom of a container is formed by a gate member 38 which is hinged or pivotably attached to one side of the container (FIG. 5) and by means of latching levers 40 adjacent the opposite side of the containers a means is provided for maintaining said gate member 38 in a closed position for retaining a load of newspapers within a container.

Figure 2:
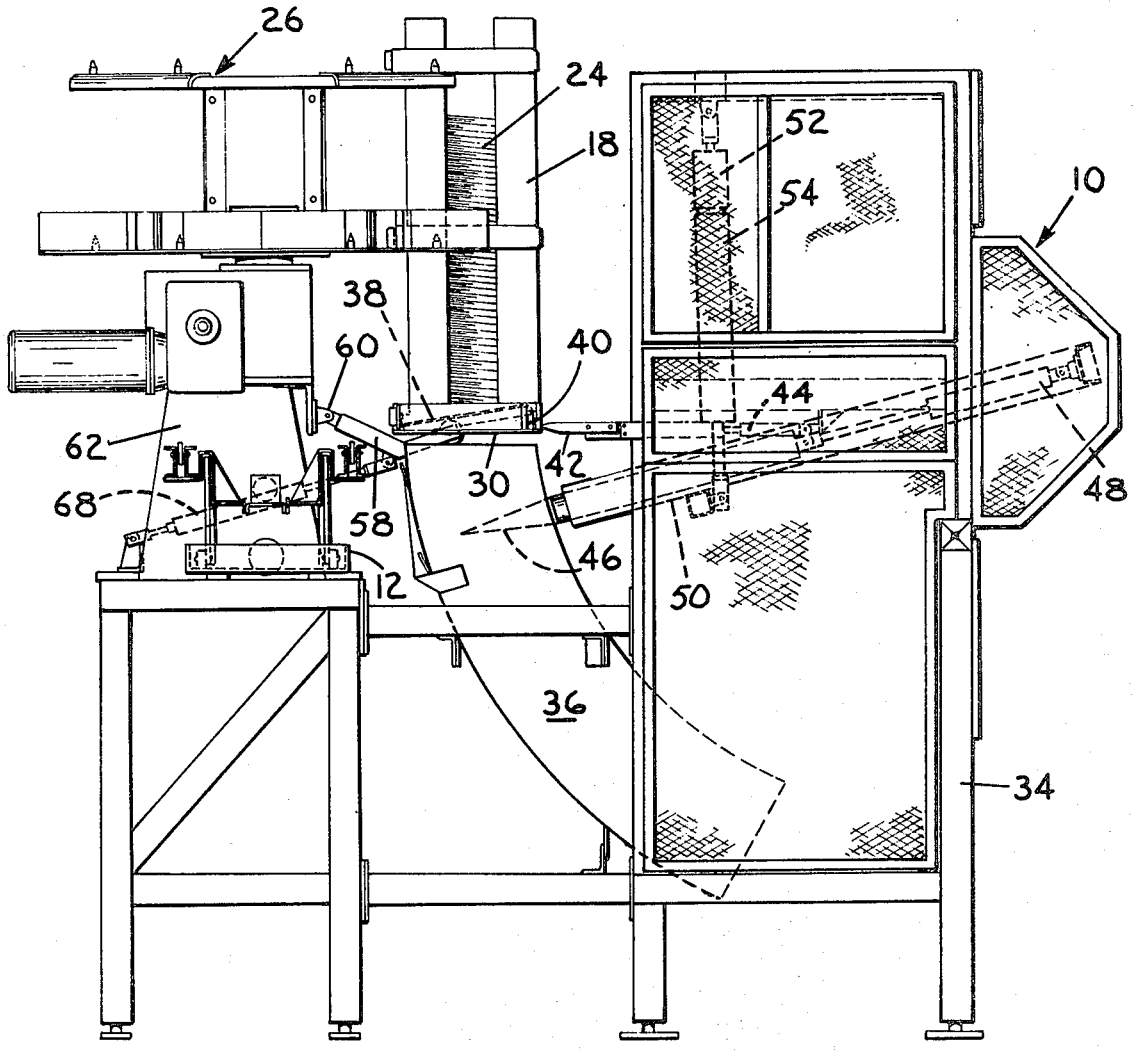
FIG. 2 is a view in side elevation of the container unloading apparatus shown in FIG. 1.
Figure 5:
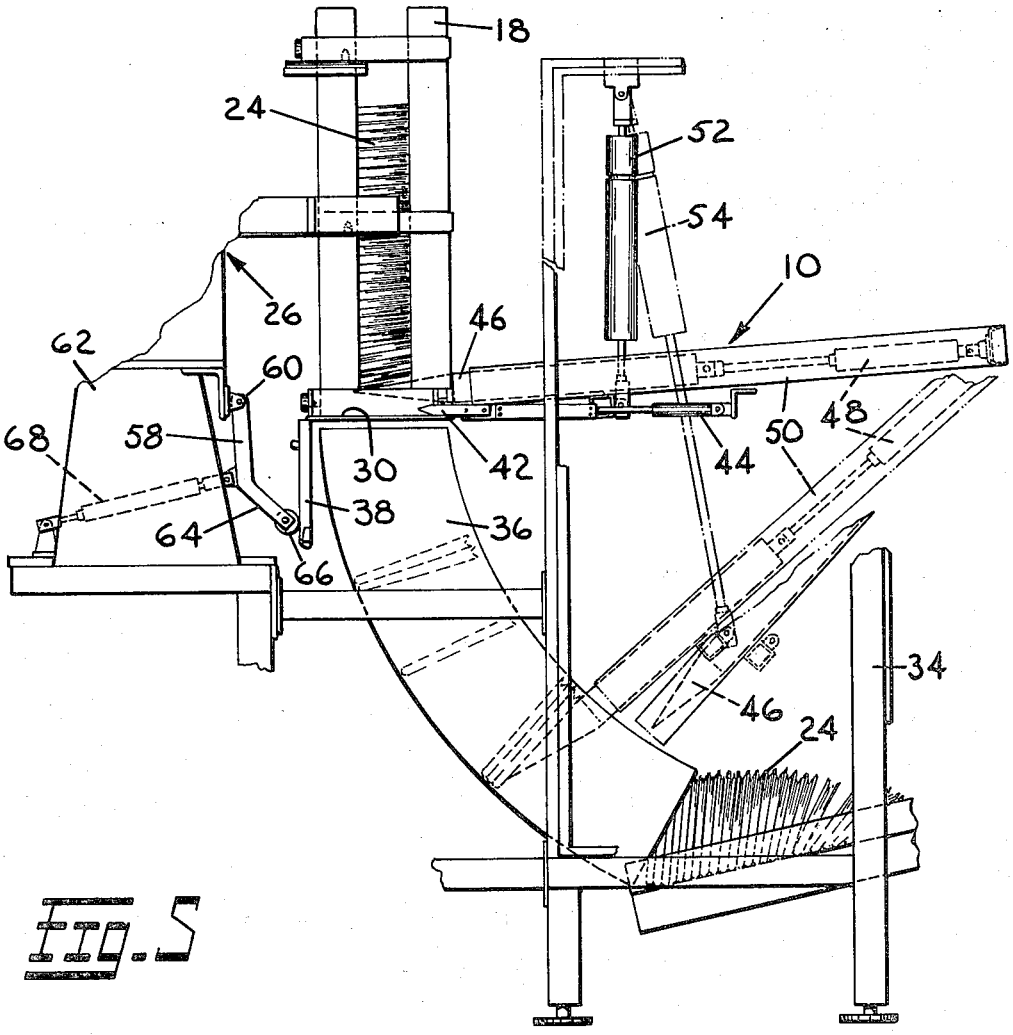
FIG. 5 is a view similar to FIG. 2 but with certain elements of the structure omitted to show further detail of the invention.

Referring now to FIGS. 2, 3 and 5 the support structure 34 has a pair of spaced bar trip members 42 each of which is moved horizontally by a pneumatic cylinder 44 to a position for pivoting a latching lever 40 to a position which releases the container gate member 38 so that it will swing downwardly to the position shown in FIG. 5. Prior to releasing the gate member 38 to its open position a pneumatically controlled paddle member 46 is caused to enter the arcuated channel 36 and be pivoted upwardly into contact with the lowermost newspaper within the container.

This paddle member 46 is mounted for longitudinal movement by a pneumatic cylinder 48 in a frame 50 which is pivotably mounted in the support structure 34.

Tandem type pneumatic cylinders 52–54 are operatively connected to the frame 50 and after the paddle member has entered the lower portion of the arcuated channel 36 (FIG. 5), the pneumatic cylinders 52 and 54 are effective in pivoting the frame 50 upwardly until the paddle member 46 engages the lowermost newspaper within the container 18. When the paddle member 46 is in contact with the newspapers, the gate member is unlatched and caused to swing to the position shown in FIG. 5. At this time the pneumatic cylinders 52 and 54 permit the frame 50 to pivot downwardly and the paddle member 46 is effective in guiding the newspapers from the container into the arcuated channel 36. From the arcuated channel 36 the newspapers are presented to a stream maker 56 from which they are conveyed to positions downstream of the storage buffer for further processing.

Prior to returning the emptied container to the transfer conveyor 12 the gate member is pivoted to its closed and latched position. This is accomplished by a closing lever 58 pivotable connected as at 60 (FIGS. 2 and 5) to the pedestal 62 for supporting the indexing rotor 26. This closing lever is provided with a pair of spaced arms 64 having a roller 66 mounted on the free end of each arm. The rollers 66 engage the underside of the gate member 38 and the lever 58 intermediate its ends is operatively connected to a pneumatic cylinder 68 that extends through an opening 70 in the pedestal 62. As is now easily understood the pneumatic cylinder is effective in swinging the gate member 38 upwardly to its closed or latched position.

Although the present invention has been described in connection with a preferred embodiment it is to be understood that modifications and variations may be resorted to without departing from the spirit and scope of the invention as those skilled in the art will readily understand. Such modifications and variations are considered to be within the purview and scope of the invention and the appended claims.

We claim:

1. Apparatus for transporting a stack of newspaper signatures from a first position inside a storage container having a pivotally mounted bottom to a second position spaced from said container for forming an imbricated stream, said apparatus comprising:

(a) supporting framework;

(b) a signature directing arcuate chute configured to receive signatures in a vertical direction and direct them in an arcuate path toward a horizontal path of travel; said chute having an elongated slot formed in one arcuate wall thereof;

(c) an elongated extensible support arm pivotally mounted on said frame so that the outer end thereof can be extended into said signature directing chute and moved through the arcuate length thereof;

(d) means to extend said extensible support arm into said arcuate chute to receive and change the position of said stack and to withdraw said outer end of said arm after said stack has been moved; and (e) means to pivot said extensible support arm to change the position of said stack and to return said arm to said first position.

2. An apparatus as defined in claim 1 wherein said elongated extensible support arm includes a support paddle on the outer end thereof and said extensible means is a linear motor for moving said paddle toward and away from the pivot point of said arm.

3. An apparatus as defined in claim 1 wherein said means to pivot is a linear motor is secured between said frame and said elongated support arm to effect arcuate movement thereof.

* * * * *